US006085665A

United States Patent [19]

Smith et al.

[11] Patent Number: 6,085,665

[45] Date of Patent: Jul. 11, 2000

[54] LABORATORY TABLE

[75] Inventors: Victor L. Smith, Crystal Springs, Miss.; Vincent A. Pari, Wetumpka, Ala.

[73] Assignee: Sheldon Laboratory Systems, Inc., Crystal Springs, Miss.

[21] Appl. No.: 09/198,288

[22] Filed: Nov. 23, 1998

Related U.S. Application Data

[60] Provisional application No. 60/080,749, Apr. 6, 1998.

[51] Int. Cl.[7] ..... A47B 85/00

[52] U.S. Cl. ..... 108/24; 108/50.01; 108/50.18

[58] Field of Search ..... 108/24, 50.01, 108/50.02, 50.11, 50.18, 50.13, 94, 103

[56] References Cited

U.S. PATENT DOCUMENTS

| | | | |
|---|---|---|---|
| 184,340 | 11/1876 | Cassiano | 108/24 |
| 2,971,656 | 2/1961 | Shoffner | 108/24 |
| 4,408,543 | 10/1983 | Griffin | 108/50.18 X |
| 4,838,175 | 6/1989 | Hauville | 108/50.18 X |
| 4,852,500 | 8/1989 | Ryburg et al. | 108/50.02 X |
| 5,416,666 | 5/1995 | Maguire, Jr. | 108/50.01 X |
| 5,568,773 | 10/1996 | Hung | 108/50.02 |
| 5,704,298 | 1/1998 | Corpuz, Jr. et al. | 108/50.01 |
| 5,743,193 | 4/1998 | Kakuta et al. | 108/50.11 X |
| 5,771,813 | 6/1998 | Jackson | 108/50.11 |

*Primary Examiner*—Jose V. Chen
*Attorney, Agent, or Firm*—Emrich & Dithmar

[57] ABSTRACT

A table particularly adapted for use by as many as four students in a science laboratory includes an elongated, curvilinear, flat countertop mounted to a movable support member on a fixed base. The curvilinear shape of the countertop affords flexibility in student seating and permits the table to be employed equally as well for laboratory experiments and for lectures. The support member can be raised and lowered by either a manual crank assembly or an electric motor for adjusting the height of the countertop. Disposed on the countertop is a turret assembly including a rotating base extending through a circular aperture in the countertop for housing a computer, which can be rotated 240° for viewing from all locations on the countertop. A semi-circular shaped sink is mounted to the fixed base in a cantilevered manner and includes a dual-radius service ledge having water and gas fixtures mounted thereto. The cantilevered manner in which the countertop and sink are attached to the fixed base affords access to the entire laboratory table for the wheelchair bound. C-clamp upright rods may be mounted to the edge of the curvilinear countertop for performing science experiments and are stored when not in use in an elongated support member below the countertop in a hidden manner.

31 Claims, 5 Drawing Sheets

LABORATORY TABLE

RELATED APPLICATION

This application claims the benefit of copending U.S. Provisional Application Ser. No. 60/080,849, filed Apr. 6, 1998.

FIELD OF THE INVENTION

This invention relates generally to work tables such as used in a science laboratory and is particularly directed to a laboratory table which can be used equally as well for lectures and which includes a computer terminal, a sink with water and gas fixtures, and an adjustable height, curvilinear work surface countertop.

BACKGROUND OF THE INVENTION

A student work table used in a school science laboratory typically includes a sink, gas and water fixtures, and a generally flat countertop with spaced holes for mounting elongated, linear rods for supporting equipment used for carrying out science experiments. The countertop is typically comprised of a high strength, durable, inert material which is resistant to corrosive chemicals and high temperatures. The countertop is also typically rectangular in shape and is supported by an upright leg in each of its four corners. Students using the laboratory table typically work in pairs, with either two students at one table or a pair of students on opposed sides of the table in facing relation. The rectangular shape of the countertop offers limited flexibility in terms of student seating, particularly during science experiments when both students are typically actively involved. The upright support legs prevent student seating in the corners of the table and thus restrict use of the entire surface area of the countertop. The corner support legs also limit access to the entire working area of the table particularly for a student sitting in a wheelchair.

The present invention addresses the aforementioned limitations of the prior art by providing a laboratory table having a curvilinear countertop mounted in a cantilevered manner to a fixed base which allows for student seating at any location around the entire periphery of the table thus increasing flexibility in student seating. This increased flexibility allows the table to be used both for lectures as well as for conducting science experiments and provides unrestricted access to the entire working area of the countertop as well as to a sink attached to the base for a student in a wheelchair.

OBJECTS AND SUMMARY OF THE INVENTION

Accordingly, it is object of the present invention to provide a laboratory table particularly adapted for use in the teaching of science which includes an adjustable height work surface countertop, a rotatable housing for supporting a computer terminal, and a sink with water and gas fixtures.

It is another object of the present invention to provide a multi-function, integrated table for use in either laboratory or lecture areas in the teaching of science which is particularly adapted for use by the wheelchair bound.

Yet another object of the present invention is to provide a laboratory table having a large flat curvilinear work surface countertop which affords increased student seating flexibility, can be adjusted in height either manually or by an electric motor, and is easily and securely locked in position at a given height.

This invention contemplates a laboratory table for use by a plurality of students which includes a flat, curvilinear countertop work surface and a sink both mounted to a fixed base in a cantilevered manner. Mounted to the countertop is a rotatable turret assembly and housing for substantially enclosing and supporting a computer terminal which can be rotated to permit viewing from anywhere on or adjacent to the countertop. A height adjustment mechanism allows the countertop and computer turret and base assembly to be adjusted in height by means of either an electric motor or manual crank assembly. The cantilevered mounting of the countertop and sink to the fixed base permits access to the sink and entire countertop by a student sitting in a wheelchair. The half-circle sink includes a dual-radius ledge around its outer periphery which is adapted to receive and provide support for water and gas fixtures while permitting access to the sink by a wheelchair-bound student. Elongated support rods having a C-clamp on one end can be attached to the edge of the flat countertop for supporting equipment during science experiments and stored when not in use in a horizontal support member beneath the countertop where they are hidden from view.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
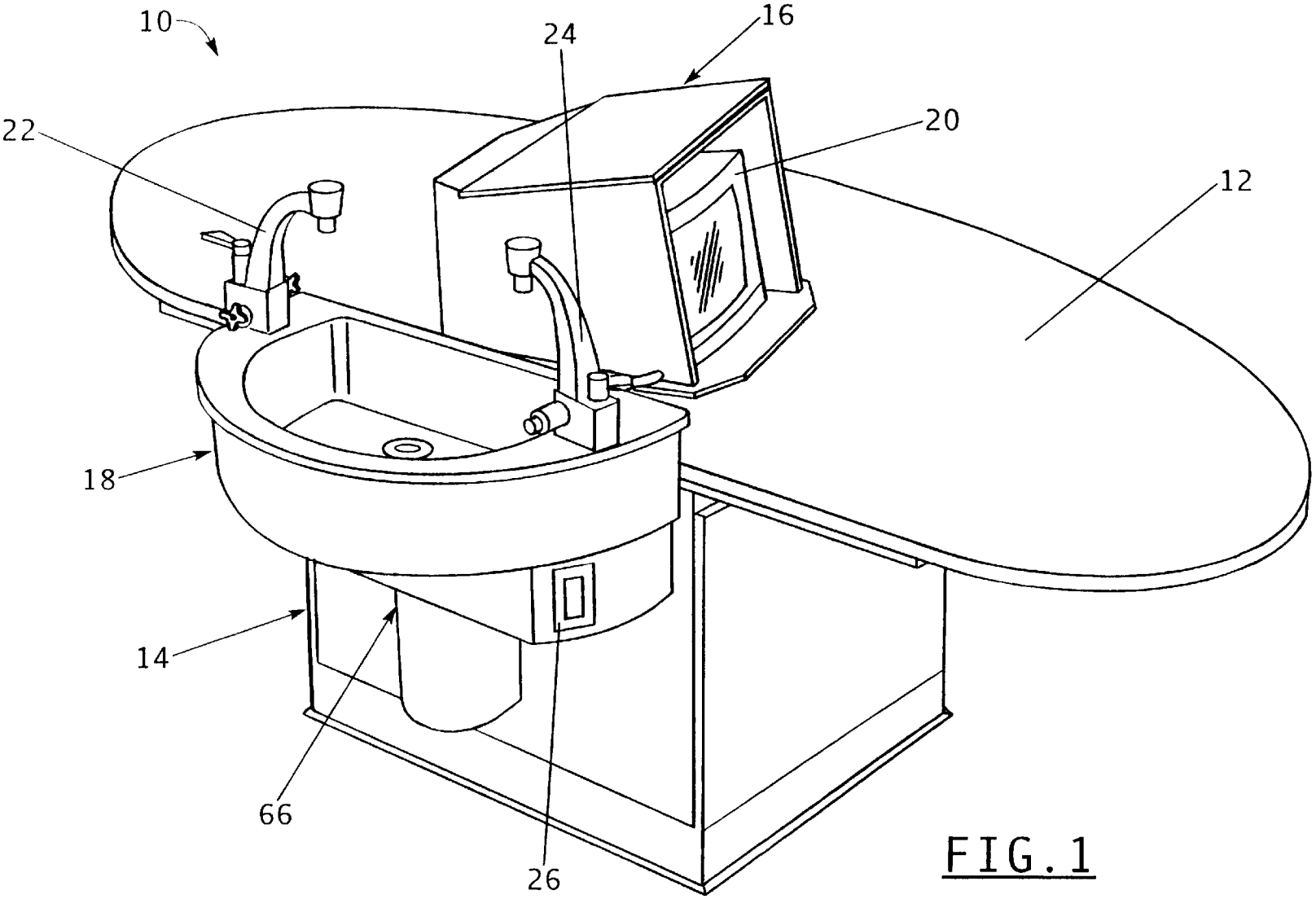
FIG. 1 is a perspective view of a laboratory table in accordance with the present invention.
Figure 2:
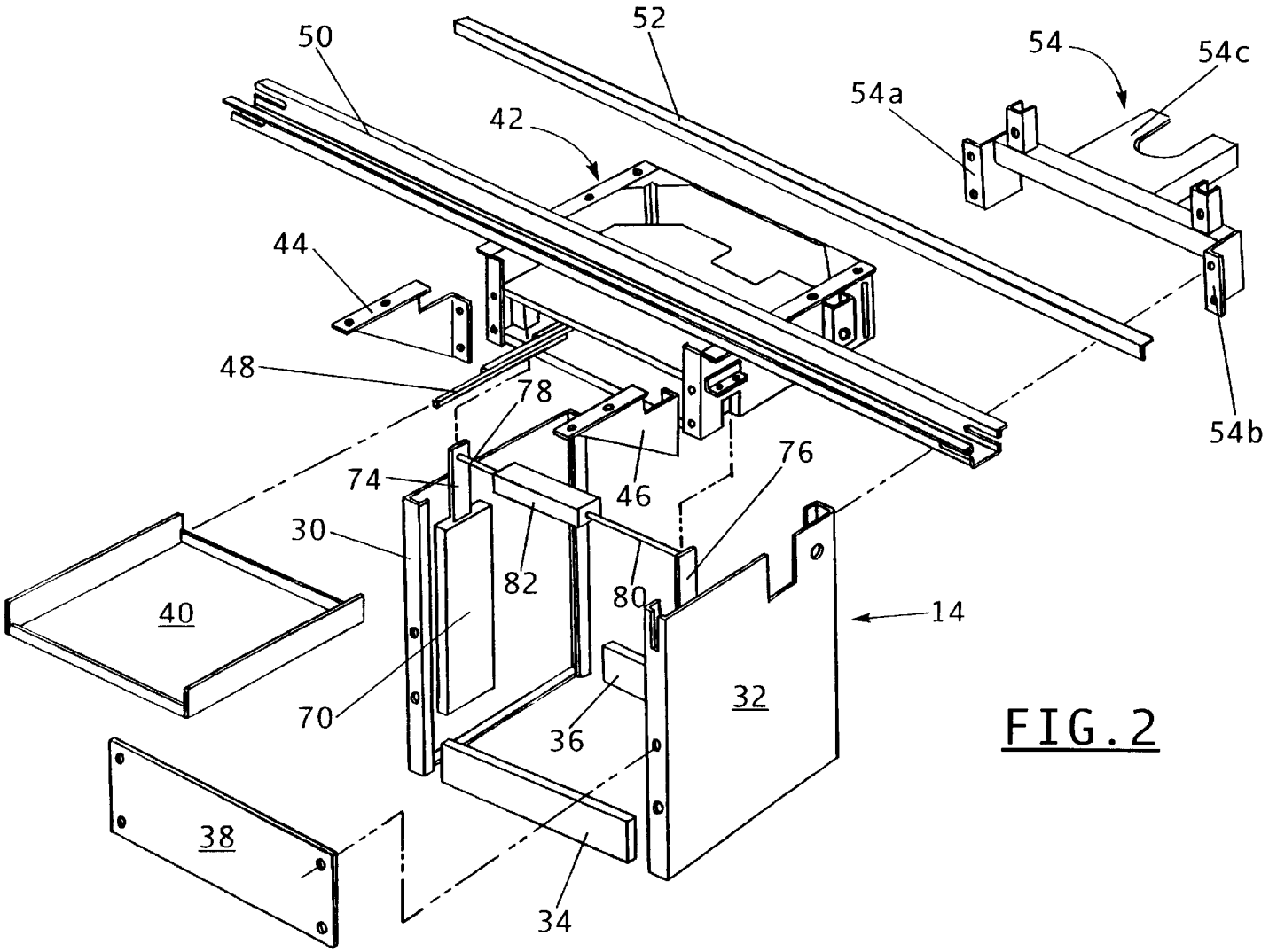
FIG. 2 is an exploded perspective view of the base structure of the laboratory table shown in FIG. 1.
Figure 3:
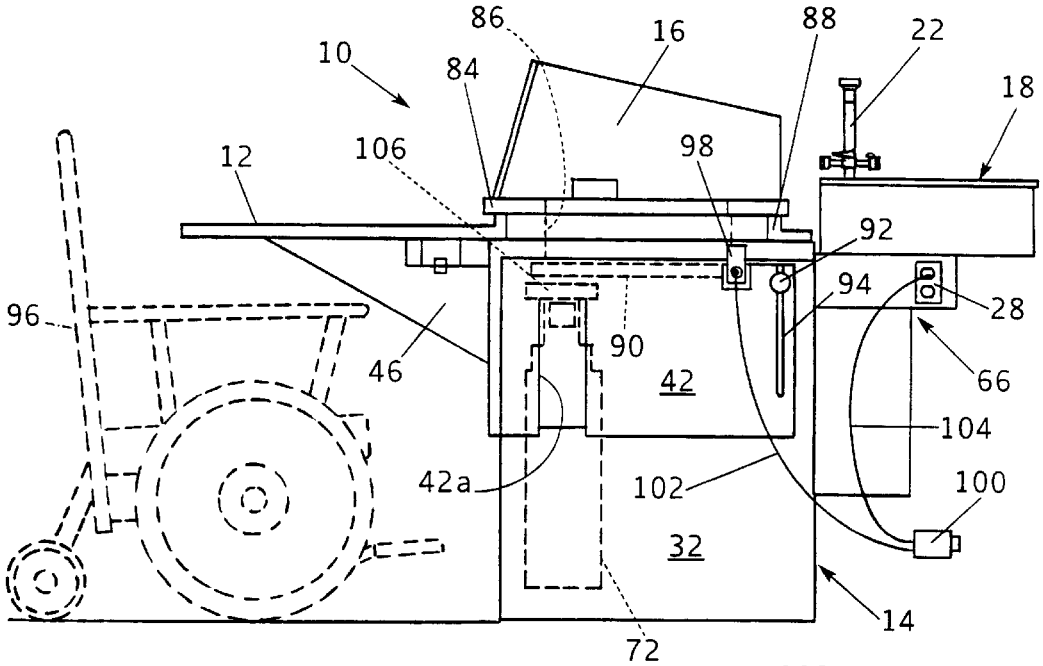
FIG. 3 is a side elevation view shown partially in phantom of the laboratory table of the present invention.

Referring to FIG. 1, there is shown a perspective view of a laboratory table 10 in accordance with the present invention. An exploded perspective view of the base 14 and other support members of the laboratory table 10 of FIG. 1 is shown in FIG. 2. FIG. 3 is a side elevation view shown partially in phantom of the inventive laboratory table 10.

Laboratory table 10 includes a generally flat, curvilinear countertop 12 disposed on and attached to a fixed base 14. Base 14 is preferably comprised of various metal components including first and second side panels 30 and 32. First and second cross members 34 and 36 are connected between lower respective portions of the first and second side panels 30,32 by conventional means such as screws or nut and bolt combinations which are not shown for simplicity. Also attached to a lower front portion of the base 14 is a front panel 38.

Attached to respective inner portions of the first and second side panels 30,32 are first and second lift mechanisms 70 and 72. Extending upwardly from the first lift mechanism 70 is a first extension arm 74, while extending upwardly from the second lift mechanism 72 is a second extension arm 76. The first and second extension arms 74,76 are adapted for telescoping movement within the first and second lift mechanisms 70,72, respectively. Vertical displacement of the first and second extension arms 74,76 within the first and second lift mechanisms 70,72 is by means of either an electric motor 82 or a hand crank assembly (not shown in FIG. 2 for simplicity) as described in detail below. Electric motor 82 is connected to the first extension arm 74 by means of a first coupling, or drive, shaft 78 and is also coupled to the second extension arm 76 by means of a second coupling, or drive, shaft 80.

Respective upper ends of the first and second extension arms 74,76 are inserted in and coupled to respective lateral recesses in a table collar 42 also by conventional means such as screws or nut and bolt combinations. Table collar 42 is disposed about an upper portion of the base 14 and moves vertically with upward or downward displacement of the first and second extension arms 74,76. Attached by conventional means such as nut and bolt combinations to a forward portion of the table collar 42 are first and second cantilevered mounting brackets 44 and 46. Also attached to the table collar 42 are a pair of drawer slides, with only one of the drawer slides shown in FIG. 2 as element 48. A pull-out tray 40 is mounted to the drawer slides and is adapted to hold a central processor (CPU) of a personal computer (PC). Pull-out tray 40 permits access to the CPU for repair, updating or replacing the CPU. Attached to an upper portion of the table collar 42 are an elongated, linear front support member, or table spine, 50 and an elongated, linear rear support member, or stiffener, 52. The front and rear support members 50,52 are securely attached to an upper portion of the table collar 42 as well as to a lower surface of the table countertop 12 by conventional means such as screws which are not shown in the various figures for simplicity. As in the case of the base 14 and its associated components, the front and rear support members 50,52 are preferably comprised of metal to provide a lightweight, support member for the table countertop 12. Attached to an aft, upper portion of the first and second side panels 30,32 by conventional means such as screws or nut and bolt combinations (also not shown) is a sink support assembly 54 which is shown in perspective view in FIG. 1*b*. Sink support assembly 54 includes first and second mounting brackets 54*a* and 54*b* on respective ends thereof for attaching the sink support assembly to the laboratory table's metal base 14. The sink support assembly 54 further includes a sink mounting bracket 54*c* for attachment to and support of the laboratory table's sink 18.

The table countertop 12 includes a generally circular aperture therein within which is disposed an annular spacer ring 88. Attached to an upper portion of the spacer ring 88 is a turret base 84. Turret base 84 is free to rotate on the spacer ring 88 which also serves as a seal about the aperture in the table countertop 12. Attached to an upper portion of the rotating turret base 84 is a plexiglass computer housing 16 within which is disposed a computer terminal 20 as shown in FIG. 1. Spacer ring 88 is disposed on and supported by the table collar 42. An upper portion of the table collar 42 and the turret base 84 each include respective aligned circular apertures therein forming a recessed monitor well 86 shown in dotted line form in FIG. 3. The recessed monitor well 86 is adapted to receive and provide a secure and stable mount for the computer terminal 20 disposed within the rotatable housing 16. Computer terminal 20 is positioned upon and supported by a rotating mount 90 (shown in dotted line form in FIG. 3) which, in turn, is supported by an upper portion of table collar 42. The rotating turret base 84 allows the computer terminal 20 to be rotated over an angular range of 240°, or ±120° relative to a line bisecting the table countertop 12 and sink 18 combination. The table countertop 12 as well as the combination of the rotating mount 90, spacer ring 88, turret base 84, rotatable housing 16 and computer terminal 20 are raised and lowered with vertical displacement of the table collar 42 as described below.

Figure 4:
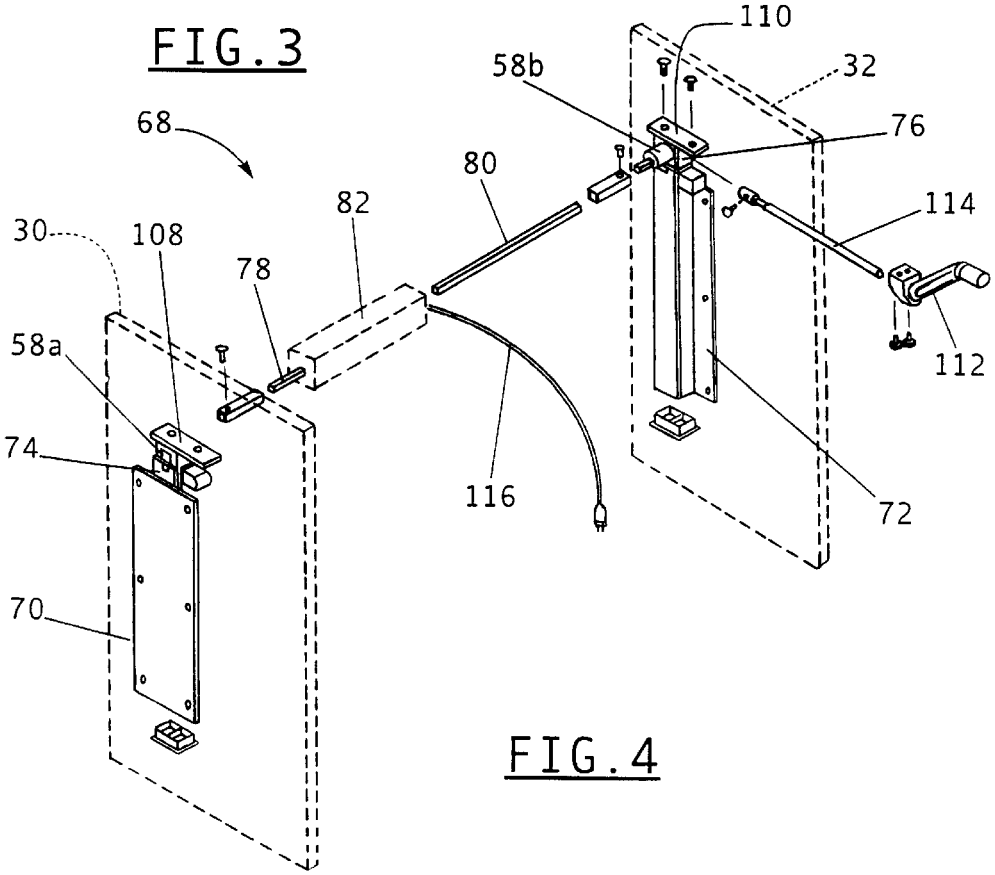
FIG. 4 is an exploded perspective view shown partially in phantom of a height adjustment mechanism for the countertop of the laboratory table.

FIG. 4 is an exploded perspective view shown partially in phantom of a height adjustment mechanism 68 for adjusting the height of the table countertop 12 and computer terminal 20 and associated rotatable mounting and support structure. The height adjustment mechanism 68 includes the aforementioned first and second lift mechanisms 70 and 72 respectively mounted to inner portions of the first and second side panels 30,32. Attached to the first and second lift mechanisms 70,72 are first and second extension arms 74 and 76. The first and second extension arms 74,76 are free to move in a telescoping manner within the first and second lift mechanisms 70,72, respectively. Attached to respective upper ends of the first and second extension arms 74,76 are the aforementioned first and second coupling shafts 78 and 80. Connected between the first and second coupling shafts 78,80 is the electric motor 82 which is attached to a fixed member in the base which is not shown for simplicity. Electric motor 82 may be coupled to an electrical outlet by means of an electrical lead 116 for driving the electric motor. When actuated, electric motor 82 rotates the first and second coupling shafts 78 and 80 for rotationally displacing respective drive gears 58*a* and 58*b* in the first and second extension arms 74,76 which, in turn, raises and lowers the extension arms within the first and second lift mechanisms 70,72. Rotating gear and rack arrangements in the lift mechanism and extension arm combinations may be conventional in design and operation for raising and lowering the extension arms and thus are not shown in detail in the figures.

An alternate arrangement for raising and lowering the table countertop 12, sink 18 and computer terminal 20 is also shown in FIG. 4. This alternate height adjustment arrangement includes a manual hand crank 112 connected by means of a crank shaft 114 to drive gear 58*b* in an upper end portion of the second extension arm 76. Rotation of the combination of hand crank 112 and crank shaft 114 in a first direction extends the first and second extension arms 74,76 from the first and second lift mechanism 70,72 for raising the table countertop. Rotation of the hand crank 112 and crank shaft 114 combination in a second, opposed direction results in retraction of the first and second extension arms 74,76 within the first and second lift mechanisms 70,72, respectively, for lowering the table countertop 12. With the first and second drive gears 58*a*, 58*b* connected by means of the first and second coupling shafts 78,80, rotation of the second drive gear 58*b* will result in a corresponding rotation of the first drive gear 58*a* such that the first and second extension arms 74,76 are raised and lowered together. In a preferred embodiment as shown in FIG. 3, a handheld control switch 100 coupled to first and second electrical leads 102 and 104 is used for raising and lowering the table countertop 12. One end of the first electrical lead 102 is inserted in an electrical outlet 98 which, in turn, is electrically coupled to motor 82. One end of the second electrical lead 104 is inserted in an electrical outlet 28 mounted to a sink and plumbing housing 66. Sink and plumbing housing 66 is attached to an aft portion of the table's metal base 14 and is disposed below the sink 18. Electrical outlet 28 is connected to an AC supply such as the laboratory or classroom wiring. The table countertop 12 may be raised or lowered by actuating the handheld control switch 100. The handheld control switch 100 and the first and second electrical leads 102,104 may be disconnected from the laboratory table and removed when the table countertop 12 is at the desired height. Disposed in respective lateral portions of the table collar 42 are first and second elongated, linear, vertical slots, where one of the vertical slots is shown as element 94 in FIG. 3. Inserted through each of the lateral slots within the table collar 42 is a respective table collar locking knob, where the locking knob inserted in the second lateral slot 94 is shown as element 92 in FIG. 3. When the table countertop 12 is adjusted to the desired height, the table collar locking knobs are rotated so as to securely engage the table collar 42 and lock the table collar in a fixed position. Each of the locking knobs is inserted through a respective threaded aperture in the first and second side panels 30,32 of the table's metal base 14.

Figure 1A:
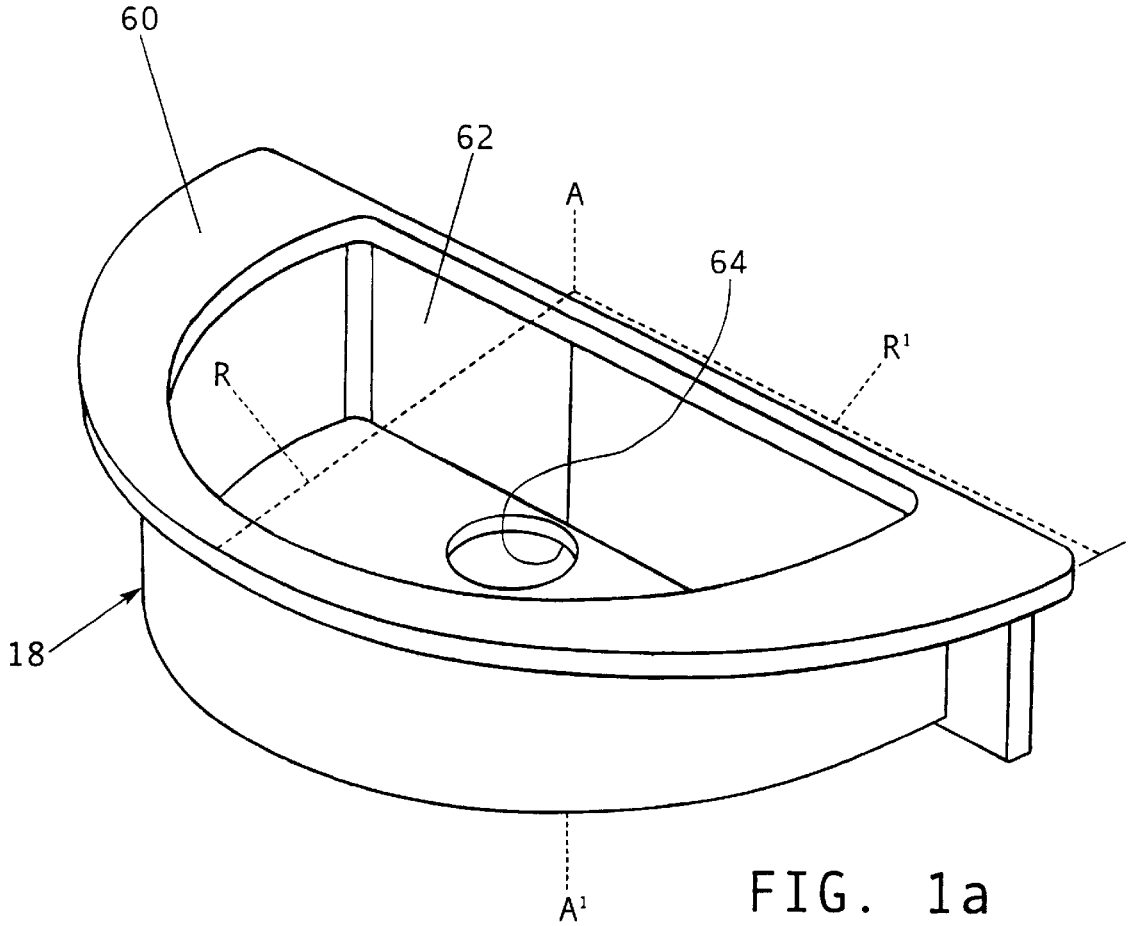
FIG. 1*a* is a perspective view of the sink used in the laboratory table of the present invention.
Figure 1B:
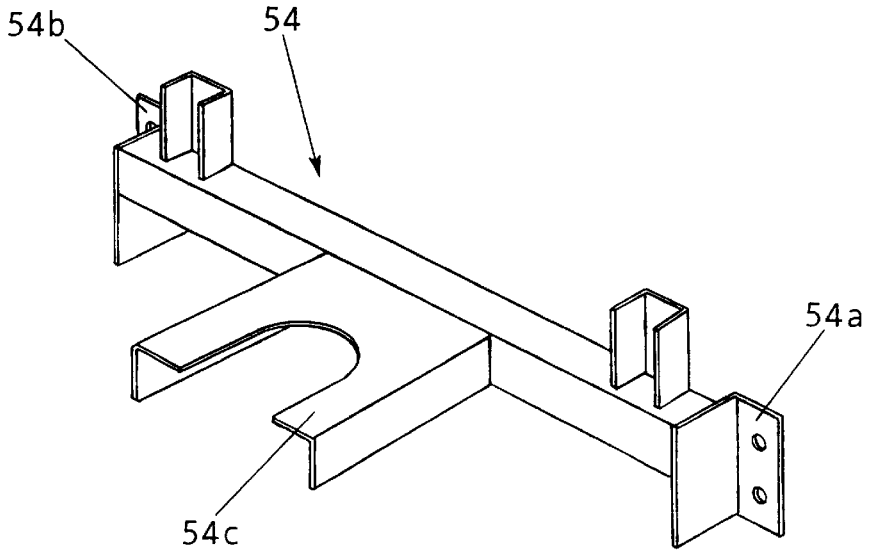
FIG. 1*b* is a perspective view of a sink support assembly used for mounting the sink shown in FIG. 1*a* in a cantilevered manner to the laboratory table's base.

Referring to FIG. 1*a,* there is shown a perspective view of the sink 18 incorporated in the laboratory table of the present invention. Sink 18 includes a recessed portion, or well, 62 having a drain aperture 64 in a lower portion thereof. Disposed about and attached to the upper portion of the recessed portion 62 of sink 18 is a dual-radius support ledge 60. The radius of the support ledge 60 is measured from the center axis of the sink 18 shown as a dotted line A—A' in FIG. 1*a*. The side portion of support ledge 60 is defined by a radius R' shown in dotted line form in the figure measured from axis A—A' to an outer edge of the ledge. Support ledge 60 is also defined by a shorter radius R shown in dotted line form in FIG. 1*a* and measured from axis A—A' to a front portion of the ledge. From FIG. 1*a,* it can be seen that R'>R. The increased width of support ledge 60 adjacent its lateral edges allows for the mounting of the first and second water and gas fixtures 22 and 24 to the support ledge as shown in FIG. 1. The reduced thickness or depth of the support ledge 60 adjacent its front edge facilitates access to the sink 18 and fixtures mounted thereto by a person in a wheelchair. The reduced radius of the support ledge 60 at this front portion permits one positioned in a wheelchair to easily reach the first and second water and gas fixtures 20 and 24. Also as shown in FIG. 3, the cantilevered mounting of the table countertop 12 and sink 18 to the laboratory table's base 14 allows a wheelchair 96 (shown in dotted line form in the figure) to be positioned beneath either the table countertop or sink to allow a person in the wheelchair full access to the entire countertop as well as to the sink.

Figure 5:
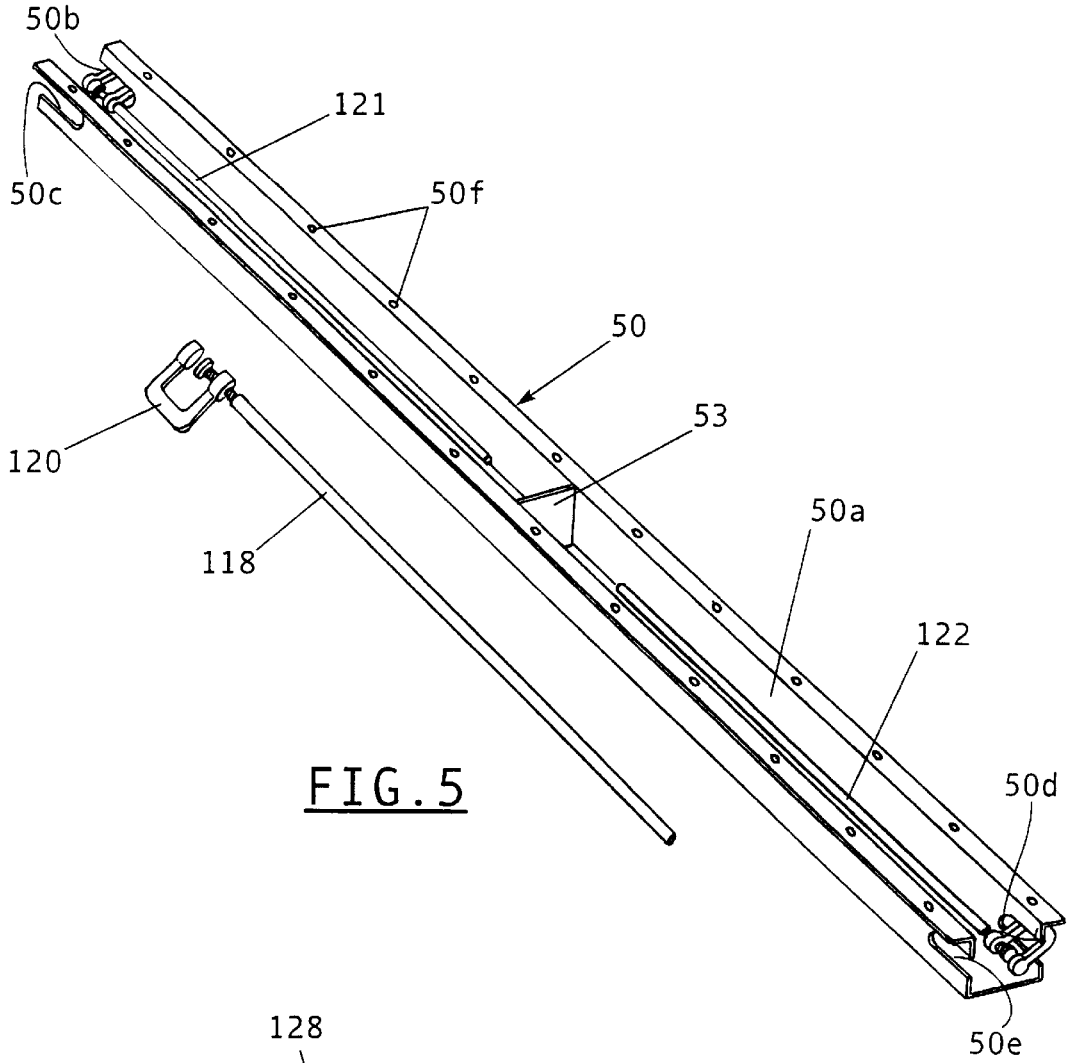
FIG. 5 is a perspective view of a front support member used in the laboratory table of the present invention illustrating the manner in which C-clamp support rods may be stored in the front support member when not in use.

Referring to FIG. 5, there is shown a perspective view of the elongated, linear front support member 50 attached to an upper portion of the table collar for mounting the table countertop to the table collar. The front support member 50 includes a recessed portion 50*a* extending the length thereof and divided into two compartments by means of a partition 53 inserted in and attached to the front support member. Disposed on a first end of the front support member 50 are first and second end slots 50*b* and 50*c*. Disposed on a second, opposed end of the front support member 50 are third and fourth end slots 50*e* and 50*d*. Each compartment formed in the recessed portion 50a of the front support member 50 is adapted to receive and store a pair of C-clamp support rods such as shown as element 118 in FIG. 5. C-clamp support rod 118 includes a C-clamp 120 on one end thereof. The end slots in each end of the front support member 50 are adapted to receive a respective C-clamp attached to a support rod. Thus, the first slot 50*b* is adapted to receive a C-clamp attached to a support rod 121. The second end slot 50*c* is similarly adapted to receive another support rod, although this is not shown in the figure for simplicity. Similarly, the third end slot 50*d* is adapted to receive the C-clamp of another support rod 122, while the fourth 50*e* is adapted to receive yet another support rod although this is also not shown in the figure for simplicity. When disposed in the front support member 50 as shown in FIG. 5, each of the support rods 121, 122 is securely maintained in a stored position and out of sight beneath the laboratory table's countertop. Disposed on adjacent upper edges of the front support member 50 are a plurality of spaced apertures 50*f*. Each of the apertures 50*f* is adapted to receive a threaded coupling member for attaching the front support member 50 to a lower surface of the laboratory table's countertop.

Figure 6A:
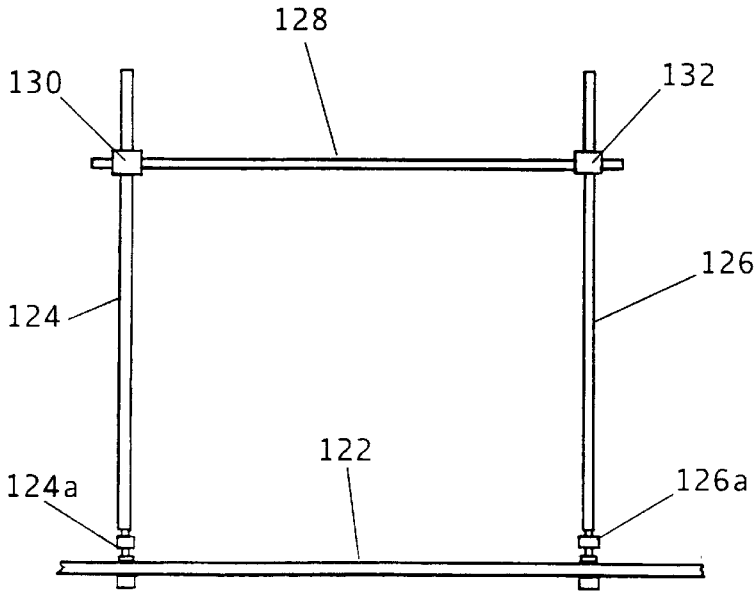
FIGS. 6*a* and 6*b* are respectively front and side elevation views of a C-clamp support rod arrangement attached to an edge of the laboratory table's countertop for supporting equipment such as during a science experiment.
Figure 6B:
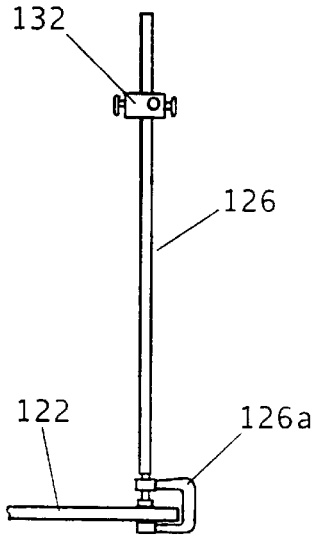

Referring to FIG. 6*a,* there is shown a front elevation view of a C-clamp support rod arrangement in accordance with another aspect of the laboratory table of the present invention. The C-clamp support rod arrangement includes first and second spaced, upright support rods 124 and 126. Attached to lower ends of the first and second upright support rods 124,126 are respective C-clamps 124*a* and 126*a*. C-clamps 124*a* and 126*a* are attached to an edge of the laboratory table countertop 122 in a conventional manner. Coupled to and extending between the first and second upright support rods 124,126 is a crossbar support rod 128 having first and second end couplings 130 and 132. The first end coupling 130 connects a first end of the crossbar support rod 128 to the first upright support rod 124, while the second end coupling 132 connects a second, opposed end of the crossbar support rod to the second upright support rod 126. The C-clamp support rod arrangement shown in FIGS. 6*a* and 6*b* may be used to position and support equipment used in the conduct of a laboratory experiment in a science class.

There has thus been shown a laboratory table which may also be used during a classroom lecture by as many as four students. The table includes an elongated, flat countertop having first and second opposed elliptical edges mounted to a fixed base in a cantilevered manner. Also attached to the base in a cantilevered manner and disposed immediately adjacent to the countertop is a sink having water and gas fixtures. A wheelchair may be placed beneath the cantilevered countertop or sink allowing full access to the laboratory table by one seated in the wheelchair. A rotating turret mount is disposed on the flat countertop and houses a computer terminal which can be rotated 240° for viewing from all locations on the countertop. The countertop and computer terminal may be raised or lowered to the desired height by means of either an electric motor or hand-operated crank mechanism. The sink is of a generally semi-circular shape and includes a dual-radius service ledge for mounting the aforementioned water and gas fixtures. The dual-radius shape of the service ledge provides the ledge with a narrow width at its outermost location to facilitate access to the entire sink by the wheelchair bound. C-clamp upright rods may be securely attached to the edge of the countertop for supporting laboratory equipment and are stored beneath the countertop where they are hidden from view when not in use.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A laboratory table for use in lectures and for laboratory experiments, said laboratory table comprising:

a base;

a generally planar countertop attached to an upper portion of and supported by said base, said countertop including a peripheral edge portion extending laterally beyond said base in a cantilevered manner;

a sink disposed adjacent the peripheral edge of said countertop and mounted to an upper, lateral portion of said base in a cantilevered manner, wherein space is provided beneath the peripheral edge portion of said countertop extending laterally beyond said base and beneath said sink for a chair such as a wheelchair to afford access to said countertop and said sink by a wheelchair-bound person; and a computer terminal disposed in or on said countertop.

2. The laboratory table of claim 1 wherein said countertop includes a peripheral edge having a linear portion and a curvilinear portion.

3. The laboratory table of claim 2 wherein the linear portion of the countertop's peripheral edge is disposed adjacent said sink.

4. The laboratory table of claim 3 wherein the curvilinear portion of the countertop's peripheral edge includes first and second generally semicircular opposed ends.

5. The laboratory table of claim 1 further comprising a rotatable housing disposed on said countertop and adapted for receiving and supporting said computer terminal, wherein said computer terminal can be rotationally displaced on said rotatable housing for allowing said computer terminal to be viewed from all locations on said countertop.

6. The laboratory table of claim 5 wherein said countertop has a circular aperture therein, said laboratory table further comprising an annular spacer and turret base coupled together, wherein said annular spacer is rotatable disposed in the circular aperture of said countertop and said turret base is coupled to and supports said rotatable housing.

7. The laboratory table of claim 6 wherein said housing is rotatable over an angular range of 240°.

8. The laboratory table of claim 1 further comprising height adjusting means for changing the height of said countertop above said base.

9. The laboratory table of claim 8 wherein said height adjusting means includes a hand-operated crank or an electric motor.

10. The laboratory table of claim 9 wherein said hand-operated crank is removable.

11. The laboratory table of claim 9 wherein said height adjusting means further includes first and second extension arms respectively coupled to a first rotating shaft and a first drive gear and to a second rotating shaft and second drive gear.

12. The laboratory table of claim 11 wherein each of said extension arms includes a respective rack assembly coupled to one of said drive gears.

13. The laboratory table of claim 11 wherein either said hand-operated crank or said electric motor is coupled to said first and second shafts and drive gears.

14. The laboratory table of claim 13 further comprising a hand-held switch coupled to said electric motor for actuating said electric motor and changing the height of said countertop.

15. The laboratory table of claim 8 further comprising locking means for fixedly positioning said countertop at a given height.

16. The laboratory table of claim 15 wherein said table further includes a collar assembly attached to a lower portion of said countertop and movable in a vertical direction in said base, wherein said collar assembly includes a lateral slot therein, and wherein said locking means includes at least one rotatable knob inserted in said slot for fixedly positioning said countertop at a given height when said rotatable knob is tightened.

17. The laboratory table of claim 1 wherein said base includes a pull-out shelf for supporting a computer component.

18. The laboratory table of claim 1 further comprising a plurality of elongated, hollow, support members coupling said base to said countertop, wherein said laboratory table further includes one or more C-clamped support rods each adapted for attachment to an edge of said countertop, and wherein each of said support members is adapted to receive one or more of said C-clamped support rods for storage when not in use.

19. The laboratory table of claim 18 wherein each of said C-clamped support rods includes a C-clamp and a support rod and wherein said C-clamp is tightened on an edge of said countertop by rotating said support rod.

20. A sink for use with a laboratory table, said sink comprising:

a generally semi-circular housing having curvilinear and flat lateral portions, wherein said sink is adapted to be mounted to an upper, lateral portion of the laboratory table in a cantilevered manner;

means defining an upper, hollow, recessed portion in said housing, said recessed portion including a drain aperture in a lower portion thereof; and a generally semi-circular support ledge disposed on an upper, peripheral portion of said housing about the hollow recessed portion therein, wherein said support ledge is tapered in width in proceeding outwardly from said laboratory table to provide first and second proximal portions with increased width and a distal portion disposed intermediate the proximal portions of said support ledge with reduced width to facilitate access to the sink by a person seated at said sink.

21. The sink of claim 20 wherein said support ledge is defined by a first inner radius R and a second outer radius R', where R'>R.

22. The sink of claim 21 wherein said first inner radius R is measured from the drain aperture in said recessed portion and said second outer radius R' is measured from the flat lateral portion of said housing.

23. The sink of claim 22 wherein a first water and gas fixture is mounted to said first proximal portion of said support ledge.

24. The sink of claim 23 wherein a second water and gas fixture is mounted to the second proximal portion of said support ledge.

25. The sink of claim 24 wherein a lower portion of the recessed portion of said housing is flat.

26. The sink of claim 25 further comprising a mounting assembly for attaching the sink to the laboratory table.

27. An arrangement comprising a laboratory table having a generally planar countertop disposed on and supported by a base structure, said arrangement further comprising:

a computer terminal;

means for defining a generally circular aperture in the laboratory table's countertop;

a base member disposed beneath and providing support for the computer terminal;

generally circular ring means disposed beneath and engaging said base member for supporting said base member and computer terminal;

rotational connecting means coupling said ring means and said base member for permitting rotation of the computer terminal for viewing from all locations on the countertop; and a recessed well disposed in said base member and said ring means for receiving and providing stable and secure positioning for the computer terminal.

28. The arrangement of claim 27 further comprising a housing disposed on said base member for substantially enclosing the computer terminal.

29. The arrangement of claim 28 wherein said housing is comprised of plexiglass.

30. The arrangement of claim 27 wherein said circular ring means tightly engages said countertop about the circular aperture therein and forms a seal with said countertop.

31. The arrangement of claim 27 wherein the computer terminal can be rotated over an angular range of 240°.

* * * * *

UNITED STATES PATENT AND TRADEMARK OFFICE

CERTIFICATE OF CORRECTION

PATENT NO. : 6,085,665

DATED : July 11, 2000

INVENTOR(S) : Victor L. Smith et al.

It is certified that error appears in the above-identified patent and that said Letters Patent is hereby corrected as shown below:

| COLUMN | LINE | DESCRIPTION |
|---|---|---|
| 5 | 34 | After "The" (first occurrence) insert --outer-- |
| 5 | 36 | "side portion" should be --outer edge-- |
| 5 | 40 | "axis A-A' to a front" should be --the center of drain aperture 64 to an inner--. |

Signed and Sealed this

Tenth Day of April, 2001

Nicholas P. Godici

*Attest:*

NICHOLAS P. GODICI

*Attesting Officer*

*Acting Director of the United States Patent and Trademark Office*